US009835387B2

(12) United States Patent
Berta et al.

(10) Patent No.: US 9,835,387 B2
(45) Date of Patent: Dec. 5, 2017

(54) FIN STRUCTURE FOR HEAT EXCHANGER FOR AUTOMOTIVE APPLICATIONS, IN PARTICULAR FOR AGRICULTURAL AND ON-SITE MACHINES

(71) Applicant: DENSO THERMAL SYSTEMS S.p.A., Poirino (Turin) (IT)

(72) Inventors: Edoardo Berta, Poirino (IT); Pasquale Napoli, Poirino (IT); Massimo Davter, Poirino (IT); Maurizio Alessio, Poirino (IT)

(73) Assignee: DENSO THERMAL SYSTEMS S.P.A., Poirino (Turin) (IT)

( * ) Notice: Subject to any disclaimer, the term of this patent is extended or adjusted under 35 U.S.C. 154(b) by 220 days.

(21) Appl. No.: 14/161,450

(22) Filed: Jan. 22, 2014

(65) Prior Publication Data

US 2014/0202674 A1 Jul. 24, 2014

(30) Foreign Application Priority Data

Jan. 23, 2013 (IT) ..... TO2013A0055

(51) Int. Cl.
*F28F 1/10* (2006.01)
*F28F 17/00* (2006.01)
*F28F 1/12* (2006.01)

(52) U.S. Cl.
CPC ..... *F28F 1/10* (2013.01); *F28F 1/126* (2013.01); *F28F 17/005* (2013.01); *F28F 2265/22* (2013.01)

(58) Field of Classification Search
CPC .... F28F 1/10; F28F 1/105; F28F 1/126; F28F 1/128; F28F 17/005; F28F 2265/22; F28D 1/02; F28D 1/0233
(Continued)

(56) References Cited

U.S. PATENT DOCUMENTS 2,035,665 A * 3/1936 Palmer ..... F28D 1/0316 165/152
2,252,211 A * 8/1941 Seemiller ..... F28F 1/126 165/151
(Continued)

FOREIGN PATENT DOCUMENTS

EP 2068106 A1 6/2009
FR EP2068106 * 6/2009 ..... F28F 1/12
(Continued)

OTHER PUBLICATIONS

Machine translation of EP 2068106.*
(Continued)

*Primary Examiner* — Len Tran
*Assistant Examiner* — Gustavo Hincapie Serna
(74) *Attorney, Agent, or Firm* — Patterson & Sheridan, L.L.P.

(57) ABSTRACT

A heat exchanger for heat exchange between air and a heat exchange medium includes a plurality of heat transfer conduits arranged parallel to each other as flow paths for the heat exchange medium and a plurality of fin members. The fin members are configured to provide: an air inlet end for air inflow, an air outlet end for air outflow, and an air flow path. The air flow path connects the air inlet end with the air outlet end and allows a heat exchange with the plurality of heat transfer conduits. Each fin member includes a plurality of undulation troughs coplanar with each other and connected together so as to define a water condensate flow path. Each water condensate flow path has a flat bottom which extends from the air inlet end to the air outlet end.

8 Claims, 3 Drawing Sheets

(58) Field of Classification Search
USPC ..... 165/152, 153
See application file for complete search history.

(56) References Cited

U.S. PATENT DOCUMENTS

| | | | | | |
|---|---|---|---|---|---|
| 2,329,789 | A * | 9/1943 | Schank | B21D 53/04 | 29/890.045 |
| 2,339,284 | A * | 1/1944 | Modine | B21D 53/04 | 165/148 |
| 3,262,495 | A * | 7/1966 | Baird | F28D 1/0316 | 165/152 |
| 3,998,600 | A * | 12/1976 | Wallis | B21D 13/04 | 165/152 |
| 4,729,428 | A * | 3/1988 | Yasutake | F28D 9/0062 | 165/153 |
| 4,796,694 | A * | 1/1989 | Ikuta | F28F 1/325 | 165/151 |
| 7,040,386 | B2 * | 5/2006 | Shimoya | F28F 1/022 | 165/153 |
| 7,445,040 | B2 * | 11/2008 | Szulman | F25J 3/04412 | 165/110 |
| 2009/0025916 | A1 * | 1/2009 | Meshenky | B21D 13/08 | 165/151 |
| 2012/0318485 | A1 * | 12/2012 | Yabe | F28D 1/05383 | 165/152 |

FOREIGN PATENT DOCUMENTS

| | | | | |
|---|---|---|---|---|
| FR | EP 2068106 | A1 * | 6/2009 | F28F 1/128 |
| JP | 2001050678 | A | 2/2001 | |
| WO | 2009/078289 | A2 | 6/2009 | |
| WO | 2011/162329 | A1 | 12/2011 | |

OTHER PUBLICATIONS

Machine Translation of EP 2068106 A1.*
EPO Search Report and Preliminary Opinion dated Apr. 10, 2014, for European Application No. 14152228.4.
Italian Search Report dated Sep. 24, 2013, for Italian Patent Application No. TO2013000055.

* cited by examiner

FIN STRUCTURE FOR HEAT EXCHANGER FOR AUTOMOTIVE APPLICATIONS, IN PARTICULAR FOR AGRICULTURAL AND ON-SITE MACHINES

BACKGROUND OF THE DISCLOSURE

Field of the Disclosure

The present disclosure relates to a fin structure for a heat exchanger for automotive applications, in particular for agricultural and on-site machines.

Description of the Related Art

The current brazed aluminium evaporators for automotive air-conditioning applications are designed for filtered environments, where the filtration is mainly intended to eliminate pollen or undesirable odours. In the case of off-road applications often the same evaporators developed for road applications are used. The latter, however, are unable to deal with the following problems: notable presence of pollutants (such as dust) which may easily clog the evaporator unit; and aggressive handling of the component, in particular during cleaning thereof. In the heat exchangers for off-road applications the unit may be cleaned by means of a brush or pressurised water and during such an operation it may happen that the component itself must be disassembled. In this case the fins may be damaged during handling of the component.

Some known evaporator configurations, which are provided with fins having louvering or undulations for increasing the turbulence of the air flow, and therefore increasing the heat exchange coefficients, are shown in FIGS. 1, 2*a* and 2*b*.

The known evaporator shown in FIG. 1 comprises a plurality of heat transfer conduits 2, in particular plate-like conduits, which are arranged parallel to each other as flow paths for a heat exchange medium. Each plate-like conduit and the adjacent conduit have, arranged in between, a plurality of fin members 3 which include respective segments of a metal sheet 5 folded in wave form and brazed to the plate-like conduits between which it is arranged. In the example shown, the metal sheet is folded in a square wave form, but other configurations for folding the sheet are known, for example a sinusoidal, triangular or other wave form.

The fin members 3 are conventionally configured to provide an air inlet end 3*a* for air inflow, an air outlet end 3*b* for air outflow, and an air flow path 3*c* which connects the air inlet end 3*a* with the air outlet end 3*b* and allows a heat exchange with the plurality of heat transfer conduits 2. According to the known configuration shown in FIG. 2, which is common in braze-welded evaporators, the fin members 3 are also configured to have louvering, namely a series of slits with a folded edge, for determining a winding path with many leading edges able to create vortices and turbulence. This louvering favours, however, the accumulation of dirt on the fins.

Another known configuration able to increase the turbulence of the air flow, and therefore increase the heat exchange coefficient, is that shown in FIG. 2*b*; according to this configuration, the fin members 3 are configured to have undulations comprising undulation peaks 7 alternating with undulation troughs 9. The known undulation configuration shown in FIG. 2, however, does not allow efficient disposal of the condensate water which forms during operation of the exchanger and collects inside the undulation troughs 9 (indicated by the areas W in FIG. 2); the air which flows between the fins is in fact unable to push all the water beyond the undulation peaks 7 and therefore as far as the end of the fin on a front side of the evaporator. This water therefore stagnates inside the undulation troughs, mixing with the dust and dirt which in the long run may result in the formation of obstructions.

The document WO 2007/013623 describes a heat exchanger, the fins of which are provided with undulations; these undulations are configured to obtain given results in terms of fluid dynamics and heat exchange, but are unable to ensure efficient disposal of the condensate water.

SUMMARY OF THE DISCLOSURE

The present disclosure relates to a fin structure for a heat exchanger for automotive applications, in particular for agricultural and on-site machines. In one embodiment, a heat exchanger for heat exchange between air and a heat exchange medium includes a plurality of heat transfer conduits arranged parallel to each other as flow paths for the heat exchange medium and a plurality of fin members. The fin members are configured to provide: an air inlet end for air inflow, an air outlet end for air outflow, and an air flow path. The air flow path connects the air inlet end with the air outlet end and allows a heat exchange with the plurality of heat transfer conduits. Each fin member includes a plurality of undulation troughs coplanar with each other and connected together so as to define a water condensate flow path. Each water condensate flow path has a flat bottom which extends from the air inlet end to the air outlet end.

BRIEF DESCRIPTION OF THE DRAWINGS

Further characteristic features and advantages of the exchanger according to the disclosure will become clear from the following detailed description of an embodiment of the disclosure, with reference to the accompanying drawings, which are provided purely by way of a non-limiting example and in which.

DETAILED DESCRIPTION

With reference to FIGS. 3 to 6, a configuration for the finning according to the disclosure is shown. Parts which correspond to those of the prior art have been assigned the same reference numbers.

Figure 3:
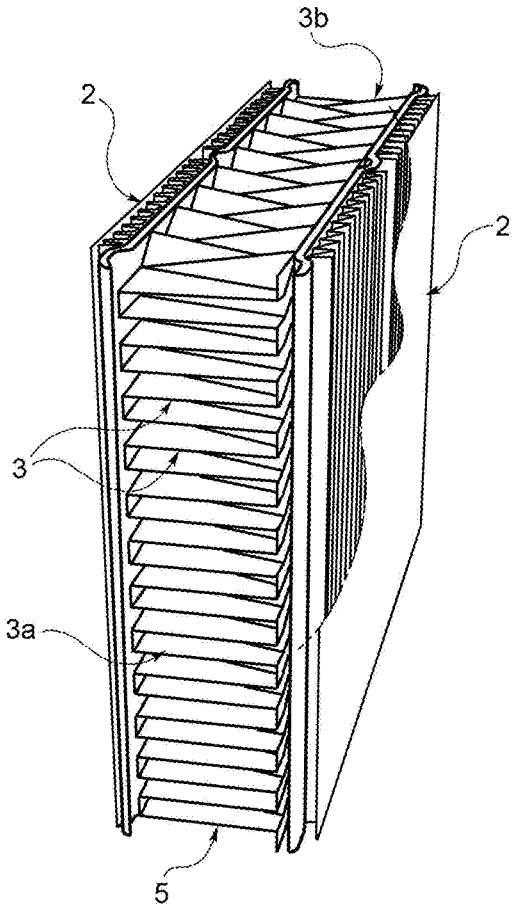
FIG. 3 is a perspective view of a segment of a heat exchanger according to one embodiment of the present disclosure.
Figure 4:
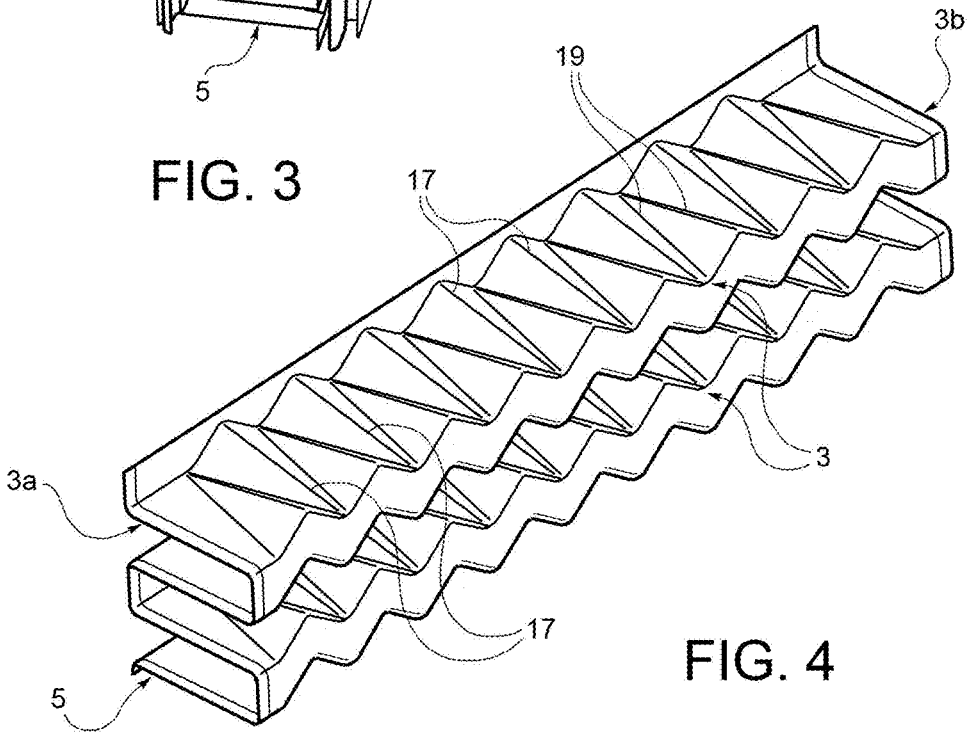
FIGS. 4 and 5 are, respectively, a perspective view and a front view of a finning segment of the exchanger according to FIG. 3.

FIG. 3 shows a segment of a heat exchanger, in particular an evaporator. In FIG. 3 it is therefore possible to see a pair of heat transfer conduits 2, in particular plate-like conduits, which are arranged parallel to each other and define flow paths for a heat exchange medium.

A plurality of fin members 3, which include, in particular of, segments of a metal sheet folded in a square wave form and brazed to the conduits 2, is arranged between the pair of conduits 2. As can be seen more clearly in FIGS. 4 to 6, the fin members 3 are configured to provide an air inlet end 3*a* for air inflow AI, an air outlet end 3*b* for air outflow AO, and an air flow path which connects the air inlet end AI with the air outlet end AO and allows a heat exchange with the plurality of heat transfer conduits 2.

Figure 1:
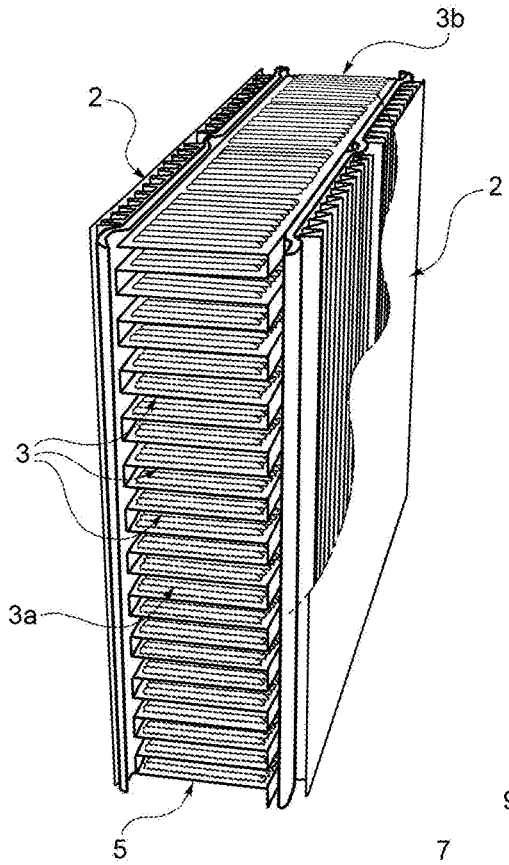
FIG. 1 is a perspective view of a segment of a heat exchanger according to the prior art.
Figure 2A:
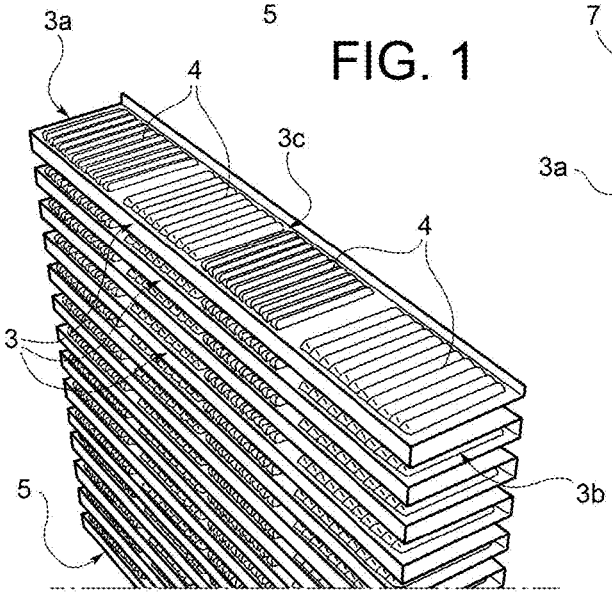
FIGS. 2*a* and 2*b* are perspective views of a finning segment for the heat exchanger according to FIG. 1, in two conventional finning configurations.
Figure 2B:
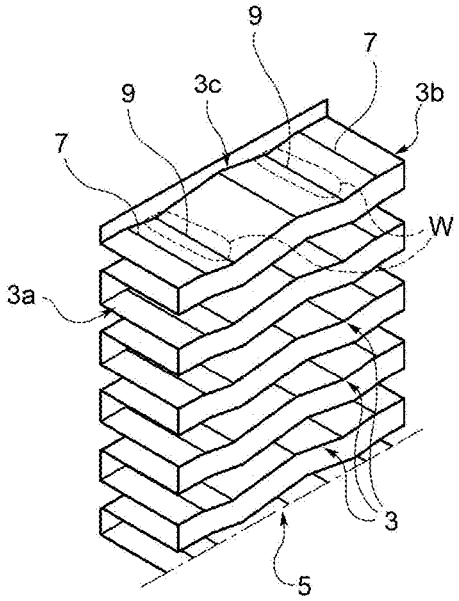

The fin members 3 are also configured to have undulations comprising undulation peaks 17 alternating with undulation troughs 19. In particular, each fin member 3 comprises a plurality of undulation troughs 19 coplanar with each other and connected together so as to define a water condensate flow path having a flat bottom which extends from the air inlet end 3*a* to the air outlet end 3*b* of the fin. The flat bottom of the condensate water flow path is shown as a grey-coloured area in FIG. 6. As can be seen in this figure, the grey-coloured flat area extends continuously along the entire length of the fin, from the air inlet end 3*a* to the air outlet end 3*b* of the fin. The water may therefore flow out easily from the front sides of the evaporator and no accumulations are formed since there are isolated dead-end troughs. From a production point of view, the undulations according to the disclosure are obtained from a flat metal sheet, as deformations which extend from one side only of the surface of the starting sheet, differently from the undulations of the known configuration according to FIG. 2*b*, in which the deformations which define the undulations extend from both sides of the surface of the starting sheet.

Each fin member 3 is configured as a strip of material extending in a main direction parallel to an axis which joins the air inlet end 3*a* to the air outlet end 3*b;* in the example shown, this axis corresponds to the direction of the thickness of the exchanger and it may therefore be stated that each fin member extends in a main direction parallel to the direction of the thickness of the exchanger. In the example shown, each fin member 3 comprises on opposite sides two opposite series of undulation peaks 17 which are interleaved with each other. As a result of this configuration the condensate water flow path has a zigzag progression.

Figure 5:
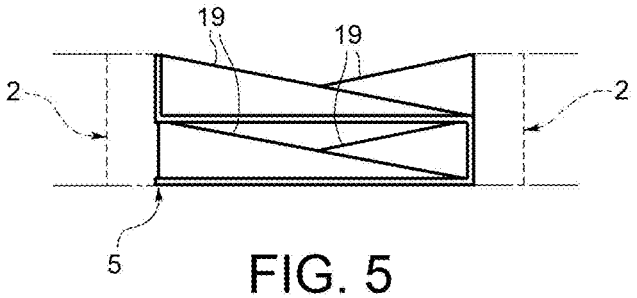
Figure 6:
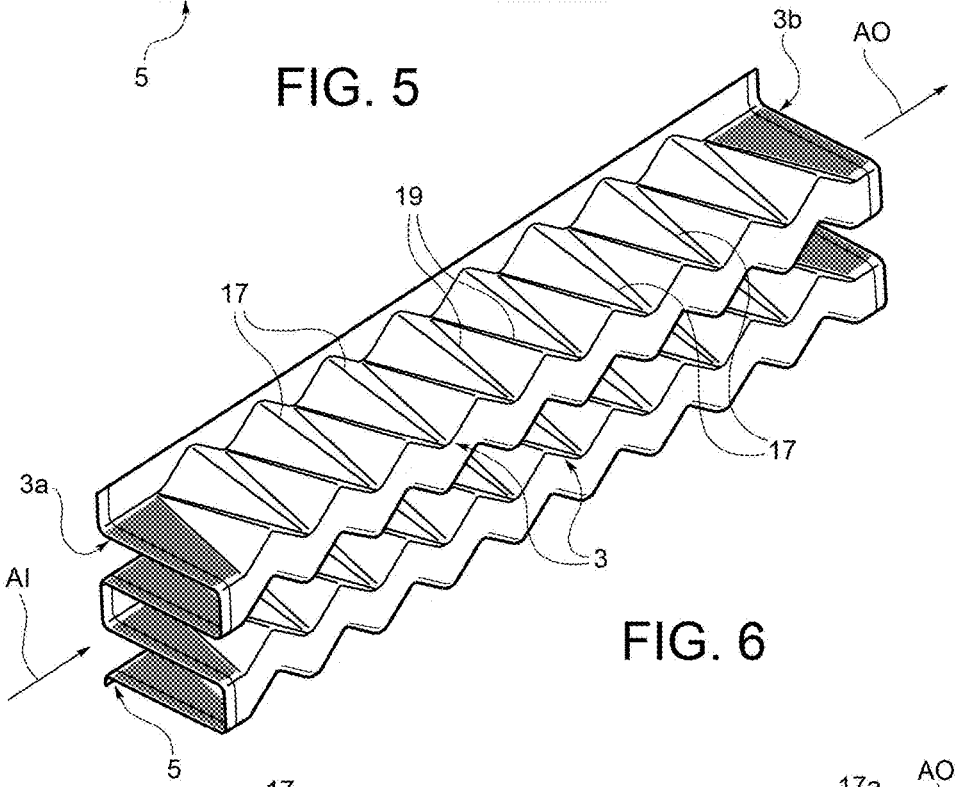
FIG. 6 is a perspective view which illustrates the operating principle of the exchanger according to FIG. 3.

In a front view of the fin member 3, shown in FIG. 5, the height of the undulation peaks of each series is decreasing or strictly decreasing in a transverse direction, from one side of the fin member 3 to the opposite side of the fin member 3.

In a plan view of the fin member 3, the undulations have an approximately triangular profile.

Figure 7:
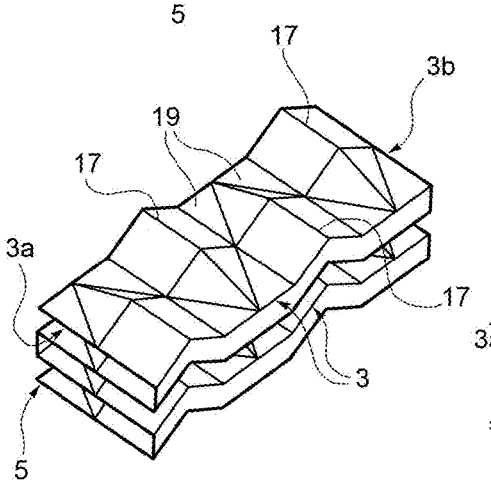
FIG. 7 is a perspective view of a segment of a heat exchanger according to a second embodiment of the disclosure.
Figure 8:
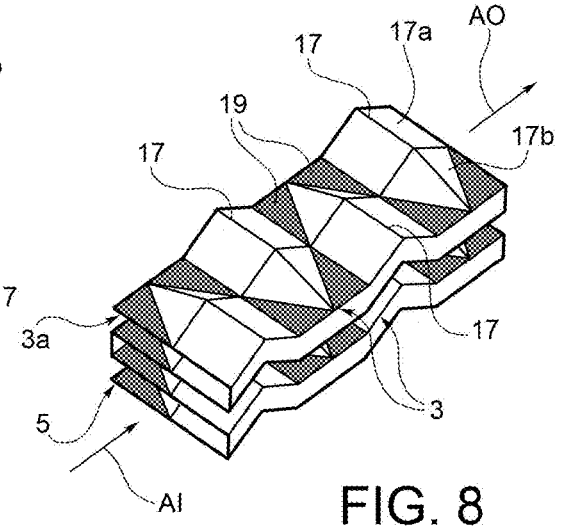
FIG. 8 is a perspective view which illustrates the operating principle of the exchanger according to FIG. 7.

FIGS. 7 and 8 show a second embodiment of the disclosure. Parts which correspond to those of the previous embodiment have been assigned the same reference numbers. This second embodiment differs from the first embodiment only in terms of the shape of the undulations; in a plan view of the fin member 3, the undulations have opposite flanks with respect to the main direction of the fin member 3, each of which has a convex profile. More precisely, the undulations are shaped in such a way as to have, in a plan view, a root portion 17*a* having flanks perpendicular to the main direction of the fin member, and an end portion 17*b* having flanks tapered towards the opposite side of the fin member.

From a production point of view, the undulations of the finning according to the disclosure is suitable for being made using rolling techniques, but may also be manufactured using other techniques, for example by means of pressing.

An object of the present disclosure is therefore to propose a heat exchanger with undulated finning, the fins of which allow drainage of the condensate water which forms between the fins during operation of the exchanger.

This object is achieved according to the disclosure by a heat exchanger of the type defined above, in which each fin member comprises a plurality of said undulation troughs coplanar with each other and connected together so as to define a water condensate flow path having a flat bottom which extends from the air inlet end to the air outlet end.

This configuration of undulations according to the disclosure creates a continuous flat path which allows the condensate water to be easily discharged, preventing damaging accumulations. This, together with the absence of louvering, reduces the amount of dirt which is deposited on the surfaces of the component and therefore decreases the frequency of the operations required for cleaning of the exchanger.

Although the disclosure has been conceived specifically for evaporators formed by plate-like conduits, it may be understood that it may be applied also to other heat exchangers of varying shape, provided that they have undulated finning.

While the foregoing is directed to embodiments of the present disclosure, other and further embodiments of the disclosure may be devised without departing from the basic scope thereof, and the scope of the invention is determined by the claims that follow.

The invention claimed is:

1. Heat exchanger for heat exchange between air and a heat exchange medium, the heat exchanger comprising:

a plurality of heat transfer conduits arranged parallel to each other as flow paths for the heat exchange medium; and a plurality of fin members configured to provide an air inlet end for air inflow, an air outlet end for air outflow, and an air flow path connecting the air inlet end with the air outlet end and allowing a heat exchange with the plurality of heat transfer conduits, said fin members being arranged parallel to each other and perpendicular to the heat transfer conduits, wherein each fin member has a width and a length, wherein each length is greater than the respective width, wherein each fin member comprises an air inlet end portion and an air outlet end portion arranged at the air inlet end and at the air outlet end, respectively, said fin members being further configured to have undulations comprising undulation peaks alternating with undulation troughs, wherein each undulation peak comprises a continuous, non-louvered portion of the fin member extending from a respective first undulation trough to a respective second undulation trough;

wherein each undulation trough extends over the entire width of the respective fin member; and wherein each fin member comprises a plurality of said undulation troughs coplanar with each other and with the air inlet end portion and air outlet end portion of the fin member, and wherein the undulation troughs are connected to each other in such a way as to define a zigzag path for condensate water flow having a flat bottom extending from the air inlet end to the air outlet end.

2. Exchanger according to claim 1, wherein each fin member is configured as a strip of material extending in a main direction parallel to an axis joining the air inlet end to the air outlet end and comprising, on opposite sides, two opposite series of said undulation peaks interleaved with one another.

3. Exchanger according to claim 1, wherein, in a plan view of the fin member, the undulations have opposite flanks with respect to the main direction of the fin member, each of which having a convex profile.

4. Exchanger according to claim 3, wherein, in a plan view of the fin member, the undulations are shaped in such a way as to have a root portion having flanks perpendicular to the main direction of the fin member, and an end portion having flanks tapering towards the opposite side of the fin member.

5. Exchanger according to claim 1, wherein, in a plan view of the fin member, the undulations have an approximately triangular profile.

6. Exchanger according to claim 2, wherein, in a front elevation view of the fin member, the height of the undulation peaks of each series is decreasing or strictly decreasing in a transverse direction, from one side of the fin member towards the opposite side of the fin member.

7. Exchanger according to claim 1, wherein said fin members comprise segments of a metal sheet folded in a wave form.

8. Exchanger according to claim 1, wherein said heat transfer conduits comprise plate-like conduits.

* * * * *